United States Patent [19]

Patel et al.

[11] Patent Number: 5,056,434

[45] Date of Patent: Oct. 15, 1991

[54] SPIN INTEGRATING SAFE AND ARM DEVICE FOR SPINNING MUNITIONS

[75] Inventors: Chiman R. Patel, Fort Wayne, Ind.; George Webb, Irvington, Ill.

[73] Assignee: Magnavox Government and Industrial Electronics Company, Fort Wayne, Ind.

[21] Appl. No.: 572,574

[22] Filed: Aug. 27, 1990

[51] Int. Cl.[5] ..... F42C 15/22; F42C 15/40

[52] U.S. Cl. ..... 102/238; 102/245; 102/262

[58] Field of Search ..... 102/262, 264, 232, 235, 102/238, 245, 243

[56] References Cited

U.S. PATENT DOCUMENTS

| | | | |
|---|---|---|---|
| 2,870,712 | 1/1959 | Brown et al. | 102/235 |
| 3,075,465 | 1/1963 | Craig | 102/262 |
| 3,721,195 | 3/1973 | Egli et al. | 102/245 |
| 3,780,660 | 12/1973 | Webb et al. | 102/262 |
| 4,078,497 | 3/1978 | Castelli | 102/245 |
| 4,145,971 | 3/1979 | Graham et al. | 102/232 |
| 4,470,351 | 9/1984 | Farace | 102/232 |

*Primary Examiner*—David H. Brown

*Attorney, Agent, or Firm*—Roger M. Rickert; Richard T. Seeger

[57] ABSTRACT

In a preferred embodiment, a safe and arm device for spinning munitions that takes advantage of the conservation of momentum law to impart a differential angular velocity to a ball rotating in a race within the device. The rotating ball is used to established discrete time intervals that can be integrated with an electronic counter to determine a safe arm distance, which distance can be programmed to be well beyond the 400-800 caliber arming distance achievable with conventional arming devices.

3 Claims, 1 Drawing Sheet

SPIN INTEGRATING SAFE AND ARM DEVICE FOR SPINNING MUNITIONS

BACKGROUND OF THE INVENTION

1. Field of the Invention

Tbe present invention relates generally to arming devices for spinning munitions and, more particularly, to novel electromechanical means to regulate the final arming of the fuze of a spinning munition.

2. 2. Background Art.

In U.S. Pat. No. 3,264,995, issued Aug. 9, 1966, to Libby et.al., describes mechanical means for arming a missile and firing it on contact, principally for use with a missile which is rotated in flight. At the heart of the mechanism is an unbalanced slider carrying the primary explosive which arms the missile by moving the primary explosive under the firing pin. Until the missile reaches a predetermined rate of rotation, such movement is prevented by spring-biased weights inserted into the sides of the slider. The slider is further prevented from such movement by the firing pin itself which, until the missile reaches arming rate of rotation, is inserted into and holds the slider in the nonarmed position. The pin is withdrawn from the slider by a centrifugal governor when a predetermined rate of rotation is reached. Thus, arming of the missile takes place at a predetermined desired distance from the point of firing. A spinning inertia ring is provided to cause detonation of the principal explosive charge upon grazing strikes having incident angles as low as 5 degrees.

U.S. Pat. No. 4,869,172, issued Sept. 26, 1989, to Webb, described a safe and arm mechanism for an pxoloding projectile to be fired from a rifled gun. The safe and arm mechanism includes a detonating device and a spin actuated escapement mechanism for delayed arming as well as a setback device normally blocking the escapement mechanism and operable upon a concurrence of axial acceleration, angular acceleration, and angular velocity above predetermined thresholds to free the escapement mechanism. A command arming arrangement normally precludes movement of the escapement mechanism into a fully armed condition and is operable upon command to free the escapement mechanism to move to the fully armed position. A void sensing mechanism for sensing deceleration caused by the projectile striking a target followed by a significant reduction of the deceleration then enables the detonating device.

The disclosures of both the above patents are hereby made a part hereof by reference.

The types of arming devices described in the above patents, as well as other commonly employed devices, are well known and provide reliable arming at 400 to 800 calibers from the gun muzzle. However, they do not provide a command arming feature to allow predetermined arming near the target area—well beyond the 800 caliber arming distance. Also, newer weapon systems and tactical methods will require greater control of the arming event to preclude the detonation of the warhead by electronic countermeasures. Such detonation can have severe consequences if it occurs in proximity to friendly forces. Thus, the armed forces have a need for a fuze that will give the required 400 to 800 calibers safe arming distance beyond the muzzle and extended arming distance to protect friendly forces and prevent detonation by electronic countermeasures.

Accordingly, it is a principal object of the present invention to provide a safe and arm device for spinning munitions, which device can provide safe arming of the munitions beyond 400 to 800 calibers from the gun muzzle.

It is an additional object of the invention to provide such a device that can prevent detonation by electronic countermeasures of the warhead on which the device is mounted.

it is a further object of the invention to provide such a device that is simple and highly reliable.

Other objects of the present invention, as well as particular features and advantages thereof, will be elucidated in, or be apparent from, the following description and the accompanying drawing figures.

SUMMARY OF THE INVENTION

Tbe present invention achieves tbe above objects, among others, by providing, in a preferred embodiment, a safe and arm device for spinning munitions that takes advantage of the conservation of momentum law to impart a differential angular velocity to a ball rotating in a race within the device. The rotating ball is used to established discrete time intervals that can be integrated with an electronic counter to determine a safe arm distance, which distance can be programmed to be well beyond the 400–800 caliber arming distance achievable with conventional arming devices.

BRIEF DESCRIPTION OF THE DRAWING

The invention will be better understood if reference is made to the accompanying drawing figures, in which.

DETAILED DESCRIPTION OF THE PREFERRED EMBODIMENTS

Figure 1:
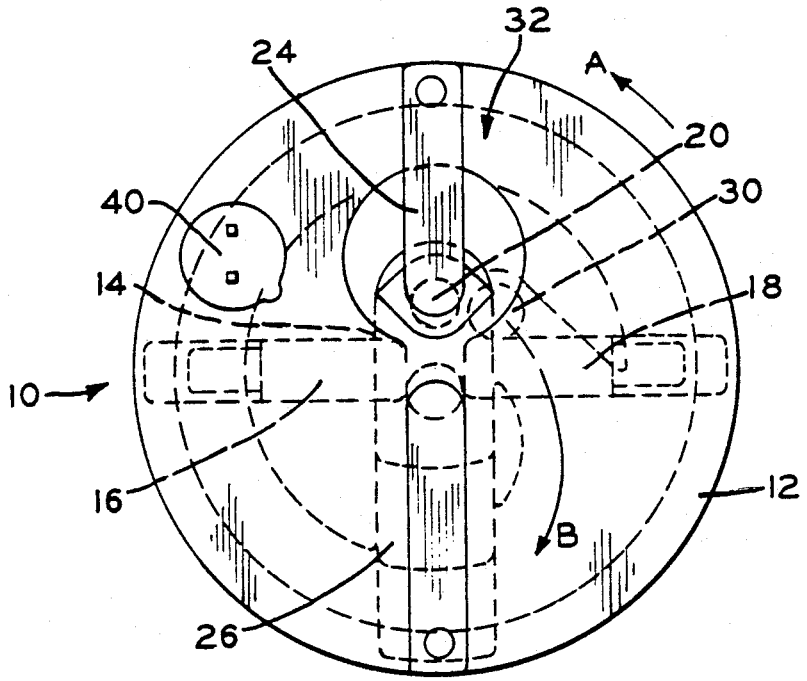
FIG. 1 is a top plan view of a safe and arm device according to the present invention.
Figure 2:
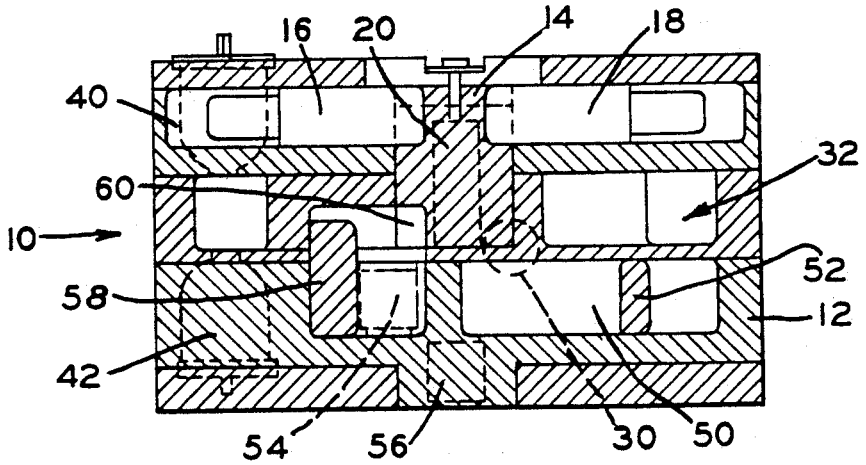
FIG. 2 is a side elevation view, partially in cross-section, of the device of FIG. 1.
Figure 3:
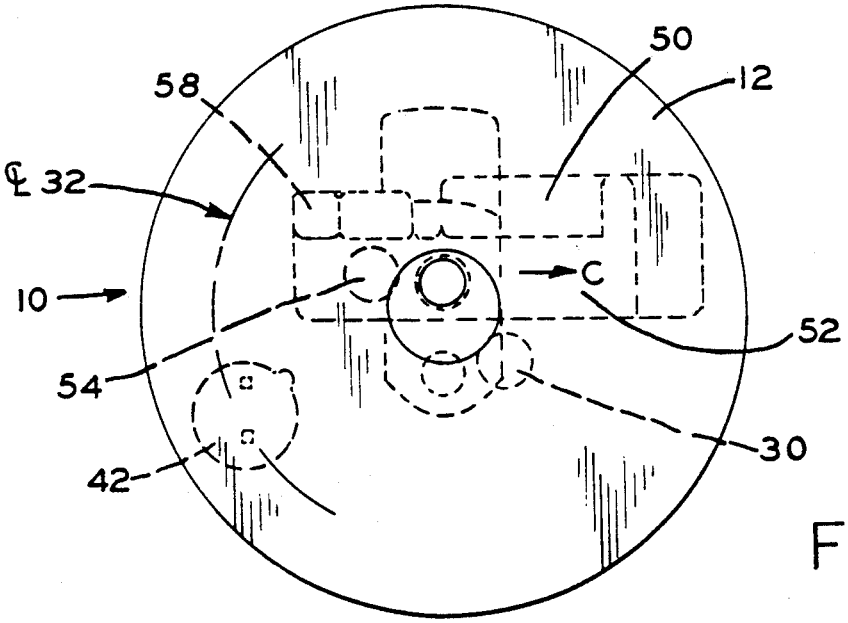
FIG. 3 is a bottom plan view, looking up, of the device of FIGS. 1 and 2.

Referring now to tbe drawing, in which similar elements are given consistent identifying numerals throughout the various views thereof, there is illustrated a safe and arm device according to the present invention, generally indicated by the reference numeral 10.

Device 10 includes a housing 12 in which is disposed for linear movement therein a slider mechanism 14 normally held against such movement by spring biased arming weights 16 and 18. The basic operation of slider mechanism 14 and associated arming weights 16 and 18 is the same as that described in U.S. Pat. No. 3,264,995. Slider mechanism 14, when in the safe position of device 10, is shorted out with a shorting contact 24 and, when in the fully armed position of device 10 is connected to the firing circuit with a firing contact 26. These electrical means of arming the detonator are well known by those skilled in the art and the operation thereof requires no detailed discussion here.

The present invention includes an integration ball 30 which is held detented by slider mechanism 14 before the arming process starts. After propulsion of the projectile (not shown) in which device 10 is mounted begins, the device rotates in the direction indicated by the arrow marked "A," arming weights 16 and 18 reach the arming spin rate, and after the normal acceleration of the weights and slider overcome the linear acceleration of the projectile down the tube of the gun, the arming weights release slider mechanism 14 and the slider will arm. The movement of slider 14 within device 10 causes an integration ball 30 to be released; however, the ball cannot move forward until the linear acceleration of the device has dropped to a low level. This drop normally occurs at the gun muzzle during blowdown, as the projectile normally has high gas pressure accelerating it during muzzle exit. If the pressure becomes low (low zone or short ranges) before muzzle exit, the net effect is minimal, since very little change in velocity or spin rate occurs at these low pressures.

When integration ball 30 is released, its tangential velocity remains about constant as the ball moves radially outward, as indicated by the arrow marked "B," to a ball race 32 along which the ball starts to roll by virtue of its momentum. However, ball race 32 has a higher rotational velocity than does integration ball 30 and the ball rolls in the ball race, due to conservation of momentum, at a reduced angular positional rate with respect to the angular velocity of device 10. In short, ball 30 rolls in ball race 32 at an angular rate that is about the same as the starting radial 1 displacement (ball detented) versus the end radial displacement (ball race). For device 10 illustrated, ball race 32 outruns integration ball 30 by a factor of approximately 2.6; or, in terms of angular: velocity, the ball appears to be moving about 38 percent as fast as the device.

Device 10 uses the differential angular velocity described above to generate a discrete time interval related to the rotation rate of the device. This time interval will be a linear function of the spin rate and, with a given rifling twist, the time interval is a function of projectile travel and can be used to determine a final arming distance. For example, with a 20 caliber twist gun and a desired arming distance of 1200 calibers, device 10 would be fully armed in (1200/20 =) 60 turns of travel. Since integration ball 30 rotates 0.38 times as fast as device 10, the corresponding number of full rotations of the ball about the axis of rotation of the device is approximately 23. Of course, the distance chosen can be programmed to be more or less than 1200 calibers.

In order to count the number of rotations of integration ball 30, there are oppositely disposed above and below ball race 32 an infrared LED 40 and a phototransistor 42. Upon the turn on of Power, light from LED 40 falls on Phototransistor 42 and turns it on. Then, each time integration ball 30 passes between the LED and the phototransistor, the light beam is broken, which action can easily be converted, by conventional means, to electrical pulses fed to a digital counter. The output of the counter can be digitally gated, again by conventional means, to produce an arming signal. Although other means of counting revolutions of integration ball 30 are within the intent of the present invention, such as magnetic sensors, electrical switching, and changing capacitance, optical sensing is preferred, since it has noise advantages over the other methods.

Following the above example, after 23 rotations of integration ball 30 have been counted, the electronic circuitry will fire an actuator 50 which moves a lead slider 52 in the direction indicated by the arrow marked "C," the movement moving a lead charge 54 in line with detonator 20 and an output lead 56 and device 10 is then fully armed.

For added safety, lead slider 52 has thereon a lock boss 58 which engages a safety detent 60 if the actuator should fire before the slider arms (fail safe).

The integration mechanism of the present invention is highly reliable and a munition equipped with the present invention cannot be detonated by electronic countermeasures.

Materials of construction of the components of device 10 and fabrication methods therefor can be any suitable ones known in the art and need not be detailed here.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A safe and arm device for a spinning munition, said device including means to fully arm said munition, comprising:

(a) a housing disposed to rotate with said munition;

(b) measuring means disposed within said housing to measure a function related to the number of revolutions of said device, said measuring means including a ball to be released at a selected point in the firing of said munition, said ball, after release thereof, being rotatable within a ball race in said housing, and means disposed within said housing to count the number of revolutions of said ball relative to the housing about the axis of rotation of said housing; and (c) means responsive to said measuring means to permit said munition to be fully armed after a selected number of revolutions of the ball relative to the housing.

2. A method of arming a spinning munition, comprising the steps of:

(a) measuring a function related to the number of revolutions of said munition after a given point in the firing thereof by releasing a mass within a housing mounted to said munition to rotate relative to said housing; and (b) fully arming said munition after a selected number of revolutions of the mass relative to the housing.

3. A method of arming a spinning munition, as defined in claim 2, wherein said mass is a ball, the step of measuring said function comprises:

(a) said ball being released at said given point in the firing of said munition;

(b) said ball, after release thereof, being rotatable within a ball race in said housing; and (c) providing means disposed within said housing to count the number of revolutions of said ball relative to said housing about the axis of rotation of said housing.

* * * * *